US006843581B2

(12) United States Patent
Mier-Langner et al.

(10) Patent No.: US 6,843,581 B2
(45) Date of Patent: Jan. 18, 2005

(54) LUMINAIRE PENDANT SYSTEM

(75) Inventors: Alejandro Mier-Langner, Providence, RI (US); Robert Scott Gosnell, Weymouth, MA (US); James E. Kuchar, Fall River, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 15 days.

(21) Appl. No.: 10/348,476

(22) Filed: Jan. 21, 2003

(65) Prior Publication Data

US 2003/0137835 A1 Jul. 24, 2003

Related U.S. Application Data

(60) Provisional application No. 60/350,657, filed on Jan. 22, 2002.

(51) Int. Cl.[7] ..... F21V 21/16

(52) U.S. Cl. ..... 362/220; 362/403; 362/407

(58) Field of Search ..... 362/220, 403, 362/404, 407, 391, 250, 239, 238, 217; 439/115, 121, 532, 716; 248/328

(56) References Cited

U.S. PATENT DOCUMENTS

| | | | | |
|---|---|---|---|---|
| 670,552 | A | 3/1901 | Brown | |
| 755,914 | A * | 3/1904 | Morse | 248/331 |
| 1,026,690 | A | 5/1912 | McGavin | |
| 1,430,156 | A | 9/1922 | Cubitt | |
| 2,335,218 | A | 11/1943 | Vacha | |
| 2,391,936 | A | 1/1946 | Wilson | |
| 2,615,123 | A | 10/1952 | Guth | |
| 3,506,232 | A | 4/1970 | Wolar et al. | |
| 3,512,743 | A | 5/1970 | Lipscomb | |
| 4,109,305 | A | 8/1978 | Claussen et al. | |
| 4,381,539 | A | 4/1983 | Sakurai | |
| D285,977 | S | 9/1986 | De Pas et al. | |
| 4,773,623 | A | 9/1988 | Nabinger | |
| 4,779,178 | A | 10/1988 | Spitz | |
| 5,317,493 | A | 5/1994 | Muller et al. | |
| 5,455,754 | A | 10/1995 | Hoffner | |
| 5,556,195 | A | 9/1996 | Glebe | |
| 5,568,970 | A | 10/1996 | Prineppi | |
| 5,772,315 | A | 6/1998 | Shen | |
| 5,836,679 | A | 11/1998 | Klamm | |
| 6,517,222 | B1 * | 2/2003 | Orlov | 362/391 |

* cited by examiner

*Primary Examiner*—Alan Cariaso
*Assistant Examiner*—Mark Tsidulko
(74) *Attorney, Agent, or Firm*—Middleton Reutlinger

(57) ABSTRACT

A pendant suspension system provides a continuously adjustable cable suspension system for luminaires. The cable suspension system has twin suspension assemblies, each comprising a cable held at both ends by a track adapter so as to form a downwardly depending loop. A luminaire is affixed on each end to the suspension system at the loop. The vertical height of the luminaire can be adjusted by pulling one end of the cable through the track adapter. Further, the luminaire can be connected to the loop through a rotation housing that permits rotational adjustment of the luminaire. Thus, the combination suspension system and rotation housing permits continuous vertical and rotational adjustment of an attached luminaire.

15 Claims, 4 Drawing Sheets

Fig. 1
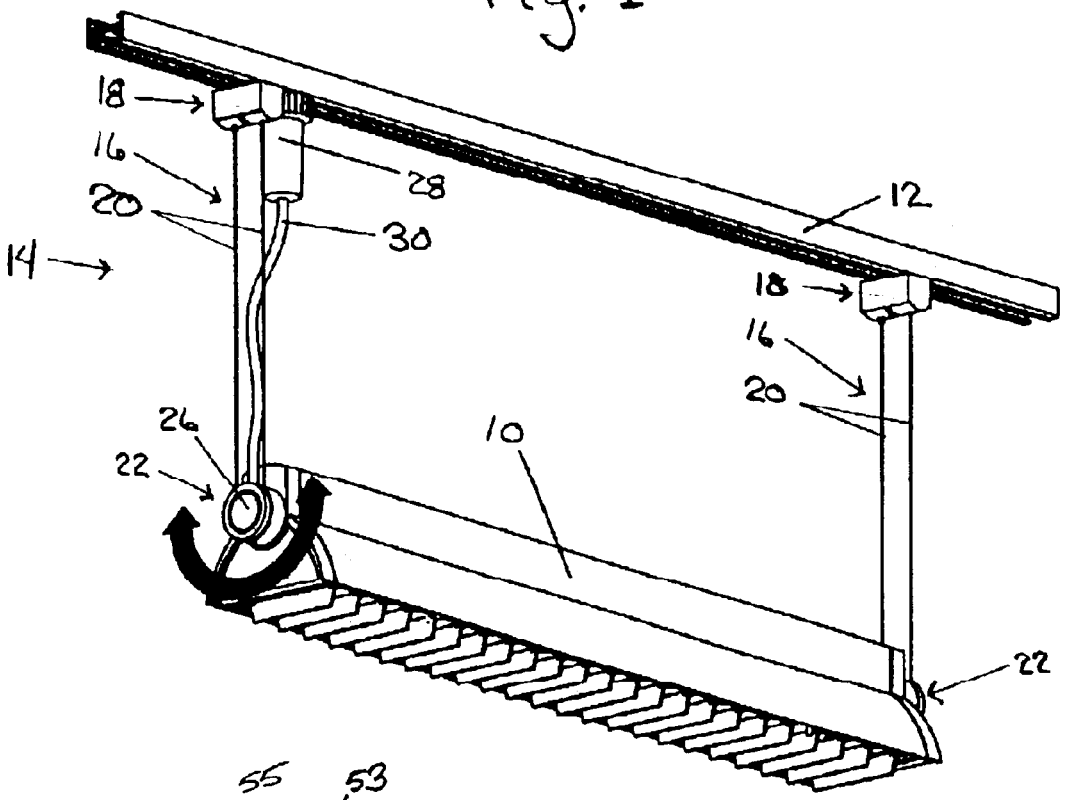
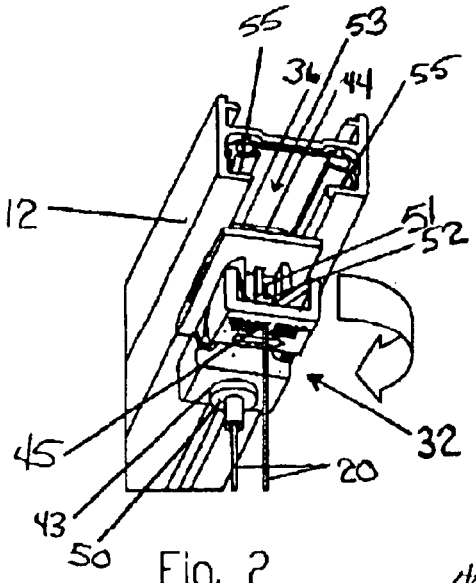
Fig. 2
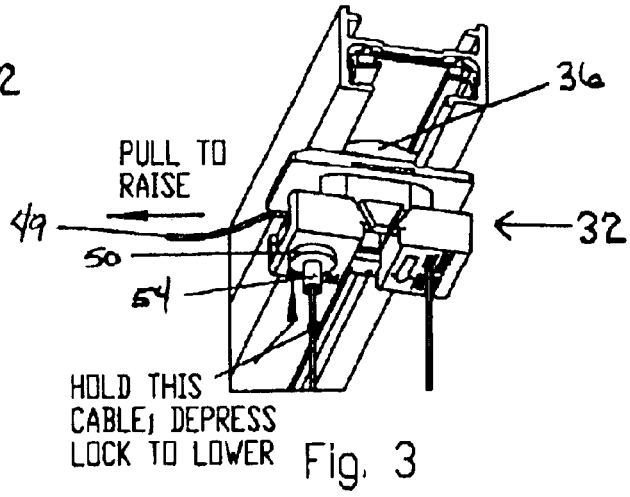
Fig. 3

LUMINAIRE PENDANT SYSTEM

CROSS-REFERENCE TO RELATED APPLICATIONS

This application claims the benefit of U.S. Provisional Application No. 60/350,657, filed Jan. 22, 2002.

STATEMENT REGARDING FEDERALLY SPONSORED RESEARCH OR DEVELOPMENT

Not applicable.

BACKGROUND OF THE INVENTION

1. Field of the Invention

This invention relates to pendant suspension systems for luminaires, and more particularly to a continuously adjustable cable suspension system for a suspended linear style track lighting luminaire having two suspension points at either end of the luminaire.

2. Description of Prior Art

Suspended linear style track lighting luminaires are typically provided with fixed length rigid stems for attaching the luminaries to lighting track. For example, ½ inch diameter pipe is often used for the stems for such pendant mounting type luminaires. However, vertical height adjustment of such rigid pendant systems is limited by the available lengths of the fixed length stems, or requires cutting and rethreading the stems to the desired length. Further, once installed, additional vertical height adjustment of the luminaire requires replacement of the stems with stems of the desired length.

Additionally, since track lighting luminaires are typically aimable, the pendant mounting system requires balance and stability to counteract the moment arms created when pivoting the luminaire for aiming.

BRIEF SUMMARY OF THE INVENTION

Thus, it is an object of the present invention to provide a suspended linear style track lighting luminaire with a continuously adjustable pendant system for attaching the luminaire to the lighting track.

It is a further object of the invention to provide a pendant system which allows vertical height adjustment of the luminaire after installation without addition or replacement of any of the pendant system components.

It is yet a further object of the invention to provide a pendant system which provides balance and stability to the luminaire to counteract the moment arms created when pivoting the luminaire for aiming.

These and other objects are met through a pendant system having twin suspension assemblies, with each assembly having a track adapter body for engaging a lighting track, a flexible support element gripper attached to the track adapter body, and an elongated flexible support element having two ends, where a first end is held by the track adapter body and the second end is adjustably held by the flexible support element gripper, where each of the flexible support elements forms an adjustable length loop from which each end of the luminaire may be suspended.

The objects are further met by a pendant system having rotation housings rotatably connected each end of a luminaire, defining an axis about which the luminaire may rotate, where each rotation housing has a channel through which a flexible support element loop suspends the luminaire. Each flexible support element loop is formed from a flexible support element having two ends, with both ends being held by a suspension assembly for attaching to a lighting track.

BRIEF DESCRIPTION OF THE SEVERAL VIEWS OF THE DRAWING

FIG. 1 is a perspective view of a linear style track lighting luminaire suspended on a pendant system of the present invention.

FIG. 2 is a perspective view of a suspension assembly and cable of a pendant system of the present invention as it is installed into a section of lighting track.

FIG. 3 is another perspective view of a suspension assembly and cable of a pendant system of the present invention as it is installed into a section of a lighting track.

DETAILED DESCRIPTION OF THE INVENTION

Figure 4:
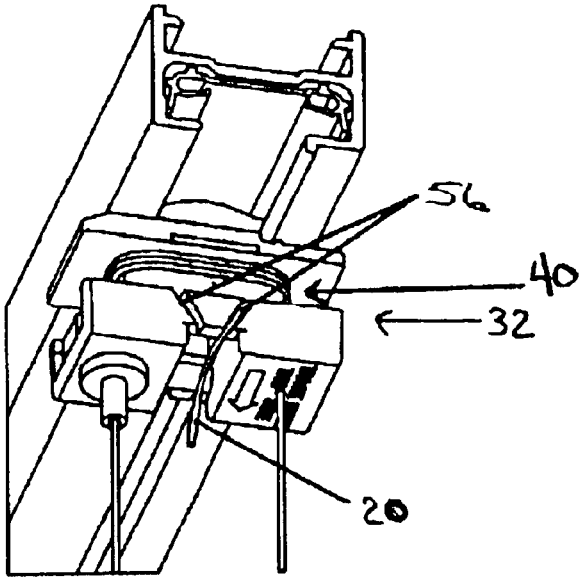
FIG. 4 is a perspective view of a suspension assembly of a pendant system of the present invention, with excess cable stored on a take-up section of the suspension assembly.
Figure 5:
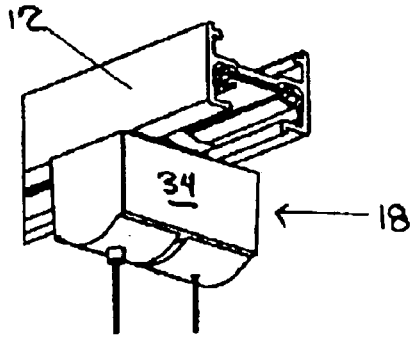
FIG. 5 is another perspective view of a suspension assembly of a pendant system of the present invention, further having a suspension assembly cover.

FIGS. 1 and 7–9 show a suspended linear style track lighting luminaire 10 attached to a lighting track 12 by a pendant system 14 of the present invention. The pendant system 14 is comprised of twin suspension assemblies 16 which engage the lighting track 12 and provide support to each end of the luminaire 10. Each suspension assembly 16 has a track adapter 18 and a cable 20. Each cable 20 is held at both ends by the respective track adapter 18, thus forming a loop. Each loop then supports an end of the luminaire 10.

The cable of the preferred embodiment of the invention is a 1/32 inch stainless steel aircraft type cable having 7×7 construction (7 twisted strands of 7 twisted strands), which provides the strength, resistance to the elements and appearance desired for the pendant system application. However, those of skill in the art will recognize that other equivalent flexible support elements may be substituted without altering the spirit or the scope of the invention described herein.

As also shown in FIGS. 1 and 7–9, a rotation housing 22 extends outward from each end of the luminaire 10. The luminaire 10 hangs by the rotation housings 22 from the loops of each cable 20.

Figure 9:
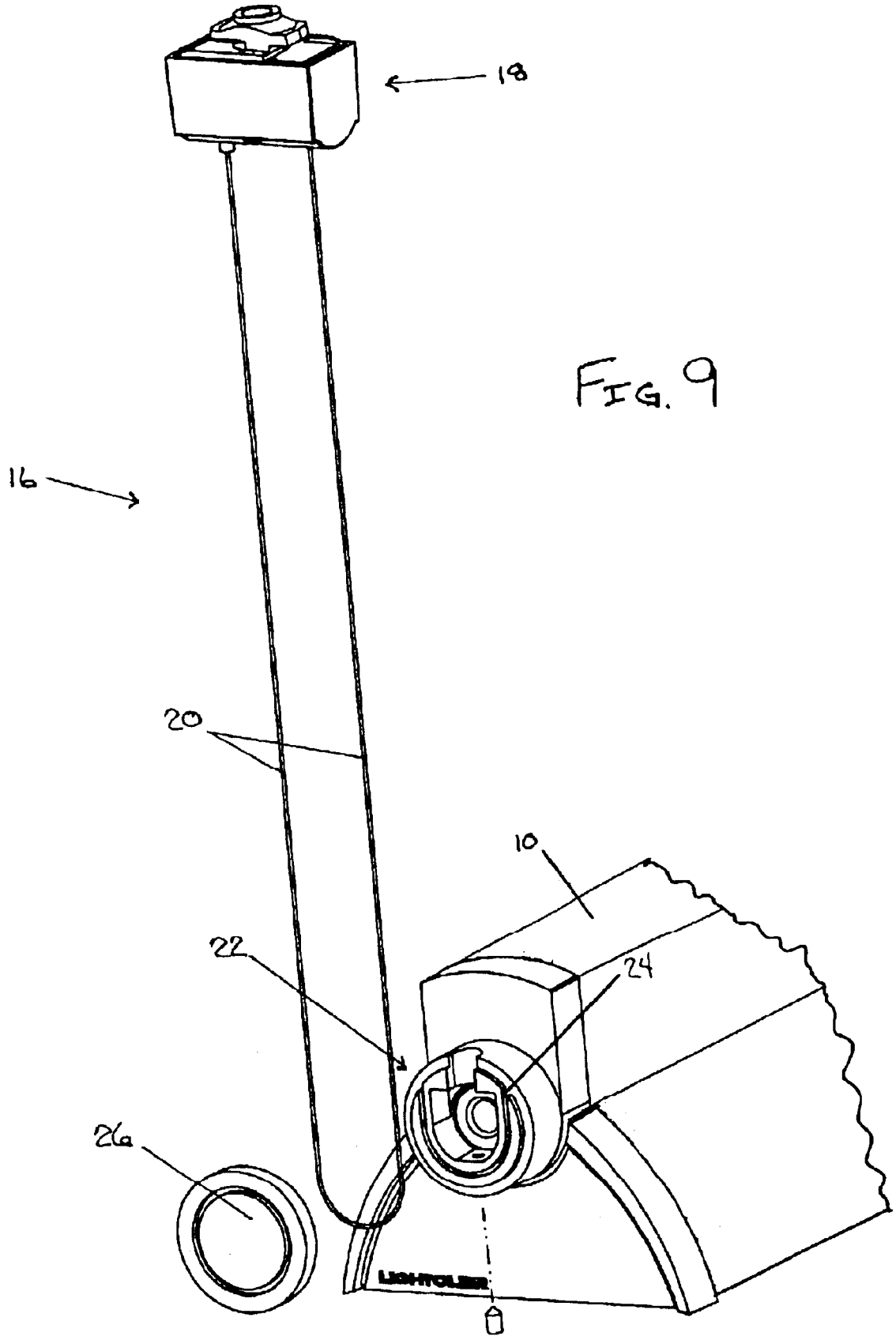
FIG. 9 is an exploded partial perspective view of the pendant system and luminaire of FIG. 1.

As shown in FIG. 9, a channel 24 is formed through each rotation housing 22. In the embodiment shown, the channels 24 are U-shaped and have entry points located along opposite sides of each rotation housing 22. Each cable 20 runs through the respective channel 24 and a cover 26 closes a side of the channel 24 in order to hold the cable 20 in the channel 24. Further, each channel 24 is large enough to allow the corresponding cable 20 to slide freely within the channel 24 so that the luminaire 10 will slide along the cables 20 to the bottom of the loops. Thus, both ends of each cable 20 support each end of the luminaire 10 in a balanced manner. Further, since the luminaire will always slide to the bottom of the loops, the pendant system is suitable for use with sloped and other ceiling configurations.

The rotation housing 22 separates the entry points into each channel 24 approximately the same distance that the ends of the cable are separated by the track adapter 18 creating a two point suspension at each end of the luminaire 10. This two point suspension provides balance and stability to the suspension of the luminaire 10 by creating multiple axes of rotation which serve to resist any rotational moments that may be created about any one of the axes alone.

Each rotation housing 22 is rotatably connected to the luminaire 10 through an eyelet type rotation joint which allows free rotation of the luminaire about an axis defined by the rotation housings 22 located at each end of the luminaire 10. Thus, the luminaire 10 may be rotated about the rotational axis for aiming the light output of the luminaire 10 a full 360 degrees around the rotational axis. In practice, rotation stops are provided within the eyelet type rotation joint in order to prevent rotation through an arc greater than 360 degrees, and damage to the electrical wiring within the luminaire 10.

Also shown in FIG. 1 is a power adapter 28 and the power cord 30 which supply power from the lighting track 12 to the luminaire 10.

As shown in FIGS. 2 through 6, each track adapter 18 has a body 32 and a cover 34.

Figure 6:
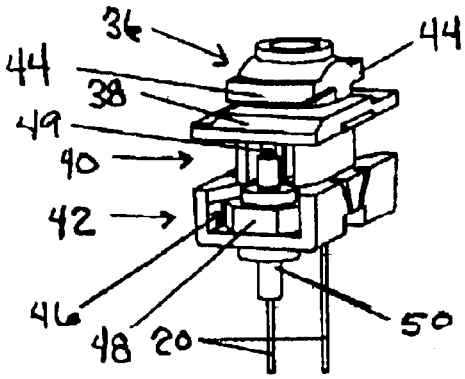
FIG. 6 is a perspective view of a suspension assembly of a pendant system of the present invention.
Figure 7:
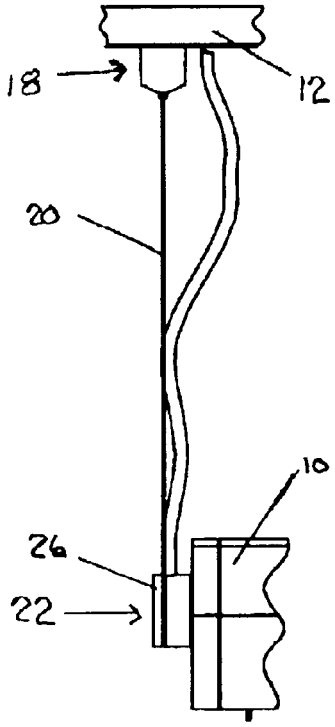
FIG. 7 is a partial front view of the pendant system, track, and luminaire of FIG. 1.
Figure 8:
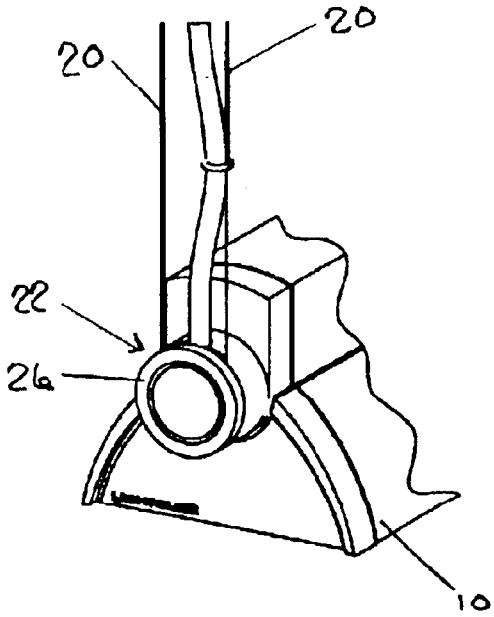
FIG. 8 is a partial perspective view of the pendant system and luminaire of FIG. 1

As best seen in FIGS. 2 and 6, each track adapter body 32 has a track adapter head section 36, an upper flange 38, a cable take-up section 40, and a base section 42 which retains the ends of the cable 20. Each track adapter head section 36 has track engaging ears 44. Each base section 42 has a channel 46 which accepts and holds a hex nut 48 in a stationary position. Aligned with and under the hex nut 48, each base section 42 further has a first hole 43. Spaced from each first hole 43, each base section 42 has a second hole 45. A flexible support element gripper, such as a cable lock device 50, having a threaded cylindrical body is threaded into each hex nut 48 through the corresponding first hole 43. A first end 51 of each cable 50 is fed through the corresponding second hole 45 and held from being pulled through the hole by a copper stop 52 crimped thereto. A second end 49 of each cable 20 is fed through and held by the corresponding cable lock device 50.

Turning now to FIGS. 2 and 3, the track adapter body 32 is attached to the track 12 by inserting the track adapter head 36 into the central channel 53 of the track cavity and rotating the track adapter body 90 degrees such that the track engaging ears 44 mechanically engage the rails 55 of the track 12. Thus, the track adapter body 32 is securely held by the track 12.

As shown in FIG. 3, following attachment of the track adapter body 32 to the track 12, the cable lock device 50 may be utilized to adjust the vertical height of the luminaire 10. The cable lock device 50 allows the cable 20 to be drawn through in one direction while preventing it from being pulled back through in the other direction unless a release mechanism is activated.

For instance, the cable lock device 50 of the embodiment shown herein is commercially available as Reutlinger Grip Lock Systems™ part number 12-M8, which utilizes a ball bearing mechanism inside of the device to wedge against the cable 20 when a force is applied to pull the cable out of the device, while easing when the cable is pulled into the device or the plunger 54, acting as a release mechanism, is depressed. One of skill in the art will recognize that other cable types and cable lock devices may be utilized without departing from the spirit or the scope of the invention described herein.

Thus, as shown in FIG. 3, the first end 49 of the cable 50 may be pulled through the cable lock device 50 to shorten the amount of cable in the loop and raise the vertical height of the luminaire 10. The luminaire 10 will balance itself at the bottom of the loop via the free movement of the cable in the rotation housing channel 24 (FIG. 9). Thusly, the vertical height of the luminaire is continuously adjustable for installation of the luminaire 10 as desired.

Further, as shown in FIG. 4, excess cable 10 may be wrapped around the take-up section 40 for future adjustment of the vertical height of the luminaire 10. V-shaped grooves 56 are supplied on either side of the track adapter body 32 for use as a cleat to lock the cable 10 in place. Thus, securing the cable 10 in the V-shaped grooves 56 will prevent an unintended release of the cable lock device 50 by an accidental depression of the spring loaded plunger 54.

The cover 34 slides up the cable 10 and over the track adapter body 32 and mates with the track adapter upper flange 38 to enclose the mechanical components of the track adapter body 32, thus giving the track adapter 18 a finished and aesthetically pleasing appearance.

This detailed description of the invention, including specific elements and configurations of elements, shall not be construed as a limitation of the invention, as it will be readily apparent to those skilled in the art that design choices may be made changing the configuration of the luminaire pendant system without departing from the spirit or scope of the invention. For instance, alternative ceiling interface arrangements, such as a fixed mount other than with a lighting track, or use of the pendant system with a luminaire other than a linear fluorescent track luminaire, would be equivalent embodiments to the embodiment of the invention disclosed herein.

What is claimed is:

1. A pendant system for suspending a linear fluorescent luminaire from a lighting track, said pendant system comprising:

a first suspension assembly for attaching to said lighting track over one end of said luminaire; and a second suspension assembly for attaching to said lighting track over the other end of said luminaire;

wherein each of said first and second suspension assemblies has:

a track adapter body having a head section for engaging said track, and a base section extending beneath said head section;

a flexible support element gripper attached to said base section; and an elongated flexible support element having a first end and a second end, said first end held by said track adapter body base section and said second end adjustably held by said flexible support element gripper;

whereby each of said first and second suspension assembly flexible support elements forms an adjustable length loop from which each said luminaire end may be suspended.

2. The pendant system of claim 1 wherein each said flexible support element is a cable.

3. The pendant system of claim 2 wherein each said flexible support element gripper is a cable lock device which further has a release mechanism, whereby each said cable lock device allows each respective cable to be drawn through in one direction while preventing each respective cable from being pulled back through in the opposite direction unless said corresponding release mechanism is activated.

4. The pendant system of claim 3 wherein each said cable lock device further has an internal ball bearing mechanism which wedges against said corresponding cable when an outward force is applied to said corresponding cable and which eases away from said corresponding cable when an inward force is applied to said corresponding cable, and wherein each said release mechanism is a spring loaded plunger which eases said corresponding ball bearing mechanism away from said corresponding cable when said plunger is depressed.

5. The pendant system of claim 4 wherein:

each said cable lock device further has a threaded cylindrical body and a mating hex nut;

each said track adapter body base section further has a hex nut receiving channel, a cable lock device receiving first hole aligned under said hex nut receiving channel, and a cable receiving second hole in spaced relation with said cable lock device receiving first hole;

each said hex nut is received in said corresponding hex nut receiving channel;

each said cable lock device threaded cylindrical body is threadedly engaged by said corresponding hex nut;

each said cable first end is received within said corresponding cable receiving second hole; and each said cable first end further has a copper stop crimped thereto, said copper stop holding each respective cable first end from being pulled through said corresponding cable receiving second hole.

6. The pendant system of claim 2 wherein each said track adapter body further has a cable take-up section positioned between said corresponding head section and said corresponding base section.

7. A pendant system for suspending a rotationally adjustable linear fluorescent track luminaire from a lighting track, said pendant system comprising:

a first rotation housing rotatably connected to one end of said luminaire and a second rotation housing rotatably connected to the other end of said luminaire whereby an axis is defined between said first rotation housing and said second rotation housing and said luminaire is rotatable about said axis, wherein each of said first and second rotation housings has a channel formed therein;

a first suspension assembly for attaching to said lighting track over one end of said luminaire and a second suspension assembly for attaching to said lighting track over the other end of said luminaire, wherein each of said first and second suspension assemblies has a track adapter body for engaging said track and an elongated flexible support element, wherein each said flexible support element has a first end and a second end, wherein said flexible support element first and second ends are held by said respective track adapter body, whereby each of said flexible support elements forms a loop;

wherein said first suspension assembly flexible support member loop runs through said first rotation housing channel to support said end of said luminaire under said first suspension assembly, wherein said second suspension assembly flexible support member loop runs through said second rotation housing channel to support said other end of said luminaire, and wherein each said flexible support member has cross-sectional dimensions smaller than the dimensions of said respective channel whereby said flexible support members are able to slide freely within said channels.

8. The pendant system of claim 7 wherein each said channel is formed through each respective rotation housing, and wherein each said channel has entry points located along opposite sides of each respective rotation housing.

9. The pendant system of claim 8 wherein each of said first and second rotation housings further has a cover which closes a side of each said channel and wherein each said channel is substantially U-shaped.

10. The pendant system of claim 9 wherein each said flexible support element is a cable.

11. The pendant system of claim 10 wherein each said track adapter body further comprises a head section for engaging said track and a base section extending beneath said head section, and wherein each of said first and second suspension assemblies further has a cable lock device attached to each said track adapter body base section, wherein each said flexible support element second end is adjustably received within each said cable lock device.

12. The pendant system of claim 11 wherein each said cable lock device further has a release mechanism, whereby each said cable lock device allows each respective cable to be drawn through in one direction while preventing each respective cable from being pulled back through in the opposite direction unless said corresponding release mechanism is activated.

13. The pendant system of claim 12 wherein each said cable lock device further has an internal ball bearing mechanism which wedges against said corresponding cable when an outward force is applied to said corresponding cable and which eases away from said corresponding cable when an inward force is applied to said corresponding cable, and wherein each said release mechanism is a spring loaded plunger which eases said corresponding ball bearing mechanism away from said corresponding cable when said plunger is depressed.

14. The pendant system of claim 13 wherein:

each said cable lock device further has a threaded cylindrical body and a mating hex nut;

each said track adapter body base section further has a hex nut receiving channel, a cable lock device receiving first hole aligned under said hex nut receiving channel, and a cable receiving second hole in spaced relation with said cable lock device receiving first hole;

each said hex nut is received in said corresponding hex nut receiving channel;

each said cable lock device threaded cylindrical body is threadedly engaged by said corresponding hex nut;

each said cable first end is received within said corresponding cable receiving second hole; and each said cable first end further has a copper stop crimped thereto, said copper stop holding each respective cable first end from being pulled through said corresponding cable receiving second hole.

15. The pendant system of claim 11 wherein each said track adapter body further has a cable take-up section positioned between said corresponding head section and said corresponding base section.

* * * * *